US006619160B1

(12) United States Patent
Buck et al.

(10) Patent No.: US 6,619,160 B1
(45) Date of Patent: Sep. 16, 2003

(54) SLIDING JAW ADAPTOR FOR PIVOTING JAW POWER TONG

(76) Inventors: David A. Buck, 1348 Sawmill Hwy., Breaux Bridge, LA (US) 70517; Daniel S. Bangert, 156 Beau Coteau Pkwy., Broussard, LA (US) 70518

( * ) Notice: Subject to any disclaimer, the term of this patent is extended or adjusted under 35 U.S.C. 154(b) by 0 days.

(21) Appl. No.: 10/139,053

(22) Filed: May 3, 2002

(51) Int. Cl.[7] ..... B25B 13/50
(52) U.S. Cl. ..... 81/57.18; 81/57.2; 81/57.21
(58) Field of Search ..... 81/57.15, 57.16, 81/57.18, 57.2, 57.21, 57.33, 57.34

(56) References Cited

U.S. PATENT DOCUMENTS 4,250,773 A * 2/1981 Haynes et al. ..... 81/57.18
4,709,599 A * 12/1987 Buck ..... 81/57.18

* cited by examiner

*Primary Examiner*—D. S. Meislin
(74) *Attorney, Agent, or Firm*—Jones, Walker, Waechter, Poitevent, Carrere & Denegre, LLP

(57) ABSTRACT

A jaw adapter for use in a pivoting jaw power tong having a cage plate designed to house a pivoting jaw member. The jaw adapter includes an adapter body shaped to fit between the cages plates of a pivoting jaw power tong. The adapter body further includes a pin assembly for engaging at least one of the cage plates, and the adapter body still further includes a sliding jaw passage. A jaw assembly is then positioned within the sliding jaw passage.

2 Claims, 6 Drawing Sheets

SLIDING JAW ADAPTOR FOR PIVOTING JAW POWER TONG

BACKGROUND OF INVENTION

The present invention relates to power tongs used to apply torque to tubular members in the oil exploration/production industry. In particular, the present invention deals with a novel device for converting a pivoting jaw power tong into a sliding jaw power tong.

Both pivoting jaw and sliding jaw power tongs are well known in the art. An example of a pivoting jaw power tong can be seen in U.S. Pat. No. 4,350,062 to Farr et al, which is incorporated by reference herein. FIG. 1 illustrates the basic components of a pivoting jaw power tong 1. A tong body 2 will enclose a ring gear 3 which will have a cam surface 4. Positioned within ring gear 3 are the pivoting jaws 5. Pivoting jaws 5 are pivotally attached between an upper and lower tong cage plate (not shown) by pivot pin 7. A roller 6 on pivoting jaws 5 will engage cam surface 4 on ring gear 3. As is well known in the art, the rotation of ring gear 3 will cause different sections of cam surface 4 to either push roller 6 toward tubular 100 (and thus cause the jaws to grip the tubular) or allow roller 6 to move away from tubular 100 (causing the jaws to release the tubular).

An example of a sliding jaw power tong may be seen in U.S. Pat. No. 5,435,213 to Buck which is incorporated by reference herein. A sliding jaw power tong has a tong body and ring gear structure similar to a pivoting jaw power tong, but the jaw is not pinned to the cage plates. A pocket for housing the sliding jaw is formed in the cage plates and the sliding jaw is moved radially toward the tubular by way of the ring gear's cam surfaces acting on the sliding jaws' rollers.

One advantage which pivoting jaw power tongs have relative to the sliding jaw variety is that pivoting jaw power tongs have a somewhat smaller overall diameter. This smaller diameter is a result of pivoting type jaws needing less radial distance within the ring gear to open and receive a tubular than is the case with sliding jaw power tongs. However, pivoting jaws also have certain disadvantages compared to sliding jaws. Generally both pivoting jaw and sliding jaw power tongs are designed to grip a range of standard tubular diameters with varying jaw sizes designed for each standard tubular diameter. For example, a 14" power tong will typically accommodate different jaw sizes for the gripping of 14" diameter down to 5" diameter tubulars. Nevertheless, because of the pivoting geometry of the pivoting jaw power tongs, these power tongs tend to grip out of tolerance tubulars with a less uniform load than sliding jaw power tongs, thereby causing damaging slippage between the jaws and the tubular. For certain types of tubulars such as well casing and production tubing, this is not a significant problem because these tubulars generally manufactured and maintained within relatively tight tolerances (e.g. +/−1/32"). However, with other tubulars such as drill pipe, the tool joint of the tubular can vary significantly in diameter (e.g. ¼") and such relatively large variations in diameter can cause a tubular to not be reliably gripped by pivoting jaw tongs.

Because sliding jaws move on a straight radial path toward and away from the tubular, this type of power tong can grip the tubular with an equally uniformly applied load over a wider range of radial distances. Thus, the wider variance in diameters found in drill pipe does not adversely effect the gripping ability of sliding jaw power tongs.

Additionally, there will be occasions in tubular handling operations when only a pivoting jaw tong is available and large tolerance tubulars must be manipulated with that power tong. It would be a significant advantage if there was a quick and economical manner of converting a pivoting jaw power tong into a sliding jaw power tong.

SUMMARY OF INVENTION

The present invention provides a jaw adapter for use in a pivoting jaw power tong having a cage plate designed to house a pivoting jaw member. The jaw adapter includes an adapter body shaped to fit between the cages plates of the pivoting jaw power tong. The adapter body further includes a pin assembly for engaging at least one of the cage plates, and the adapter body still further includes a sliding jaw passage. A jaw assembly is positioned within the sliding jaw passage.

The present invention also includes a method of converting a pivoting jaw power tong into a sliding jaw power tong. The method comprises the steps of: a) providing a pivoting jaw power tong; b) removing the pivoting jaw from the power tong; and c) positioning a sliding jaw adapter within the power tong. The sliding jaw adapter includes an adapter body shaped to fit between the cages plates of the pivoting jaw power tong. The adapter body further includes a pin assembly for engaging at least one of the cage plates, and the adapter body still further includes a sliding jaw passage. A jaw assembly is then positioned within the sliding jaw passage.

DETAILED DESCRIPTION OF INVENTION

Figure 2:
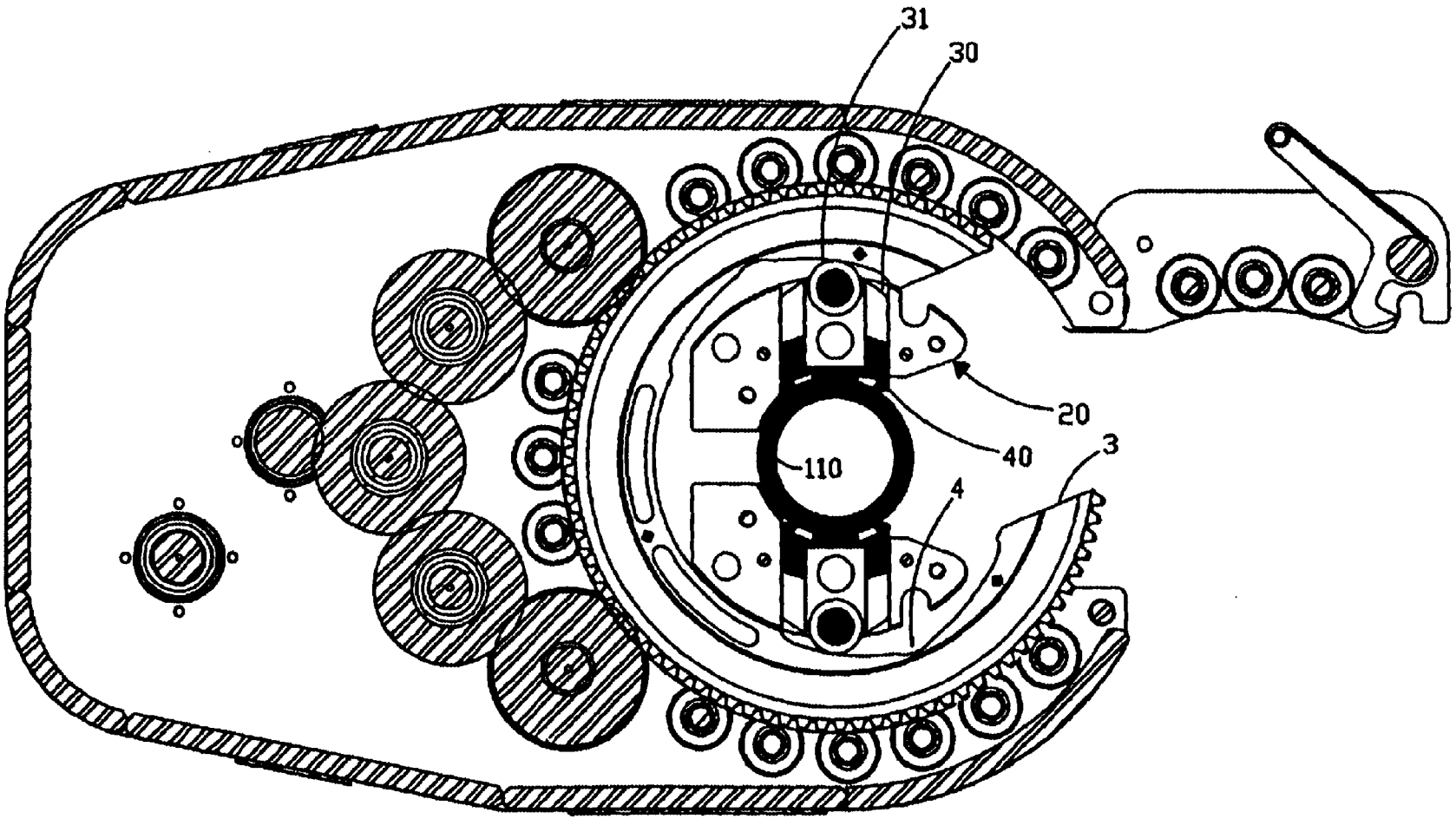
FIG. 2 is a top view of the ring gear and sliding jaw adapter of the present invention.
Figure 3:
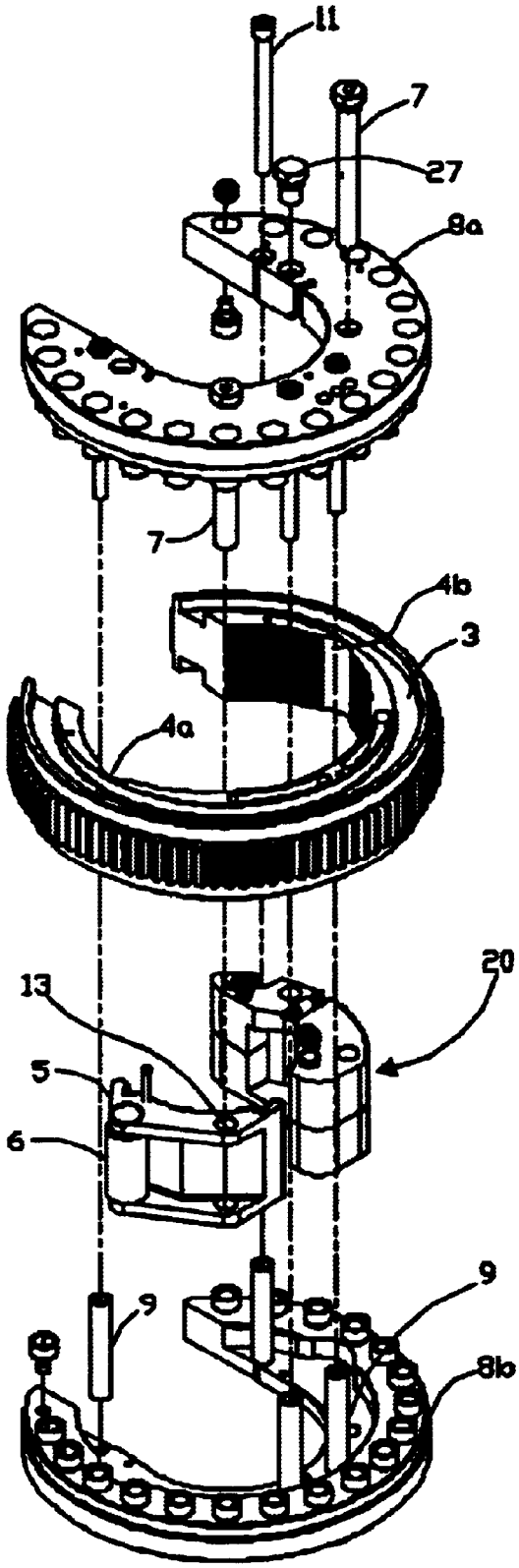
FIG. 3 is an exploded view of the cage plates, ring gear, and sliding jaw adapter of the present invention on one side of the ring gear and a conventional pivoting jaw on the other side.

While FIG. 2 shows the present invention, sliding jaw adapter 20, positioned within a power tong, FIG. 3 more clearly shows how jaw adapter 20 will be positioned relative to the upper and lower cages plates 8*a* and 8*b* and ring gear 3. For the sake of comparison, FIG. 3 also shows a prior art pivoting jaw member 5. However, it will be understood that the power tong will be operating either with two prior art pivoting jaw members 5 or, in accordance with the present invention, will have both pivoting jaw members 5 replaced with jaw adapters 20. As is well known in the art, cage plates 8*a* and 8*b* will be held together at the proper spacing by way of spacers 9 and spacer bolts 11 inserted therethrough. It can be seen from FIG. 3 how the pivot pin 7 extending from the bottom of top cage plate 8*a* would extend through pivot pin aperture 13 on pivoting jaw 5 such that cam surface 4*a* (on ring gear 3) would act against roller 6 to pivot pivoting jaw 5 on pivot pin 7.

Figure 4:
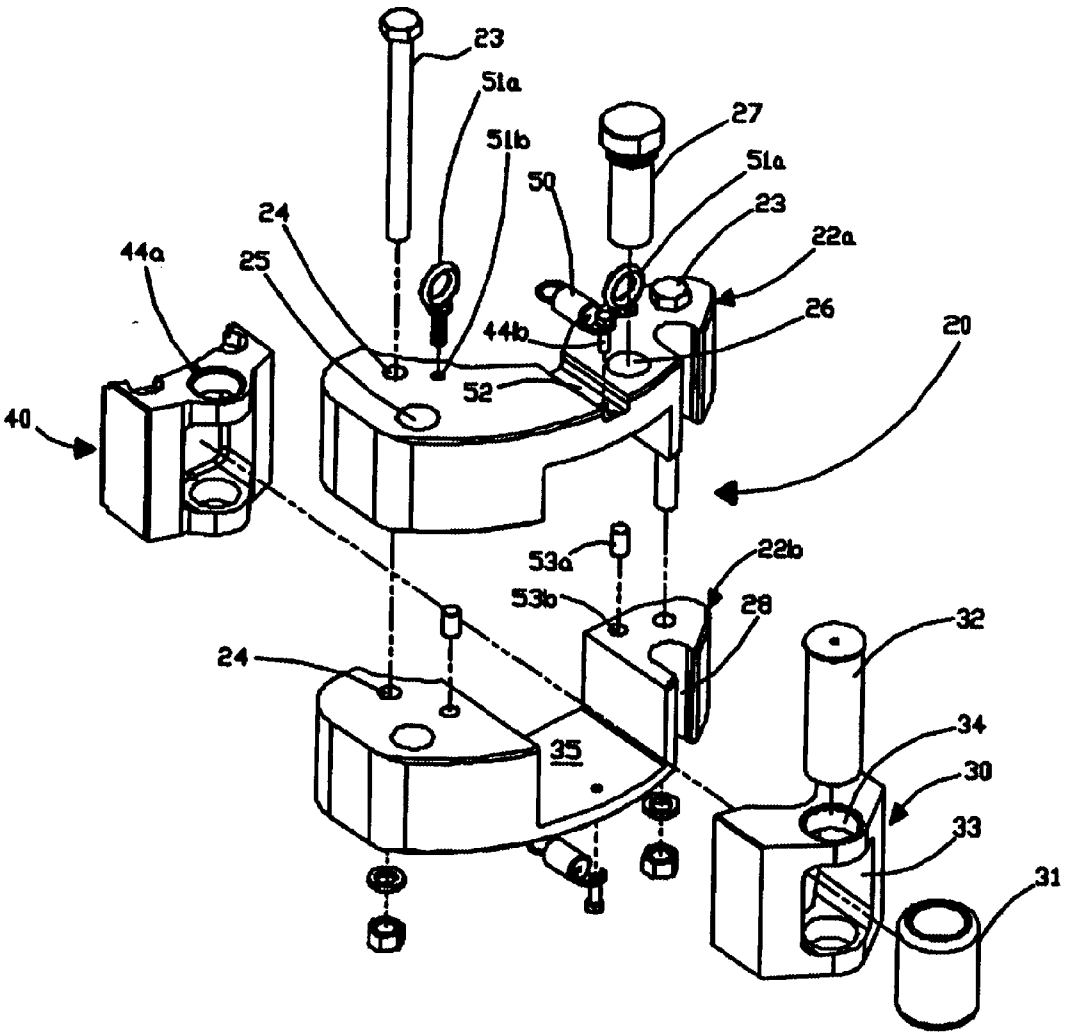
FIG. 4 is an exploded view of the sliding jaw adapter of the present invention positioned within the power tong of FIG. 1.

The specific details of jaw adapter 20's construction are best seen in the exploded view of FIG. 4. Jaw adapter 20 will generally comprise an adapter body 22 formed by an upper half 22*a* and a lower half 22*b*. Formed though the mid-portion of adapter body 22 will be a jaw passage 35. Sized to slide within jaw passage 35 will be pusher 30. Pusher 30 will have a rounded rear surface similar to conventional jaw member 40. Also like conventional jaw members, pusher 30 will include an open section 33 and pin apertures 34. A conventional roller 31 will fit within open section 33 and be rotatively pinned into place by roller pin 32. The design of roller 31 and pin 32 may be any convention type, with one example being disclosed in U.S. Pat. No. 5,819,605 to Buck et al., which is incorporated by reference herein.

The two sections of adapter body 22 will be held in alignment by pins 53*a* engaging apertures 53*b* which are formed in both upper half 22*a* and lower half 22*b*. A pair of body connecting bolts 23 will pass through apertures 24 and hold upper and lower adapter body halves 22*a* and 22*b* securely in together. Adapter body 22 will include a spacer groove 28 to accommodate the spacer tubes 9 (FIG. 3) running between upper and lower cage plate 8*a* and 8*b*. There will also be a pair of lifting rings 51*a* engaging ring apertures 51*b* and which will provide a convenient handhold for the heavy metal adapters. The outer top surface of both adapter body halves 22*a* and 22*b* will include a retaining spring 50 positioned in a retaining spring groove 52 and attached at one end by spring bolt 44*b*. Retaining spring 50 will attach to spring bolt 44*a* on jaw member 40 and bias jaw member 40 toward the rear of adapter body 22 as is explained in greater detail below. Finally, a locking pin 27 is intended to pass through upper cage plate 8*a* and engage locking pin aperture 26. The combination of locking pin 27 and pivot pin 7 (see FIG. 3) will hold adapter 20 firmly against rotation. Locking pin 27 and locking pin aperture 26 form but one type of locking pin assembly. Those skilled in the art will undoubtedly methods of securing adapter 20 against rotation relative to the cages plates and all such methods are intended to come within the definition of "locking pin assembly."

Figure 5:
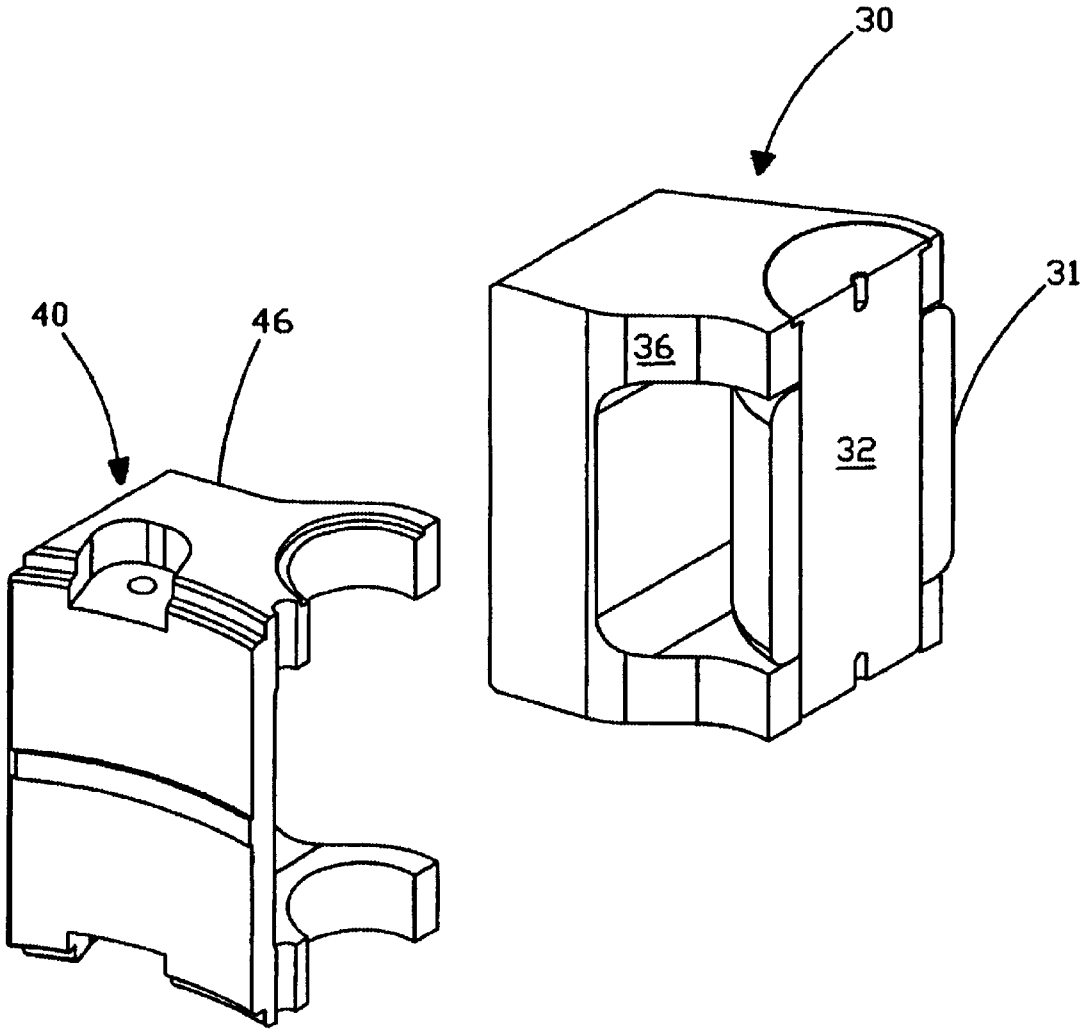
FIG. 5 is a perspective view illustrating the jaw member and pusher utilized in the present invention.
Figure 6:
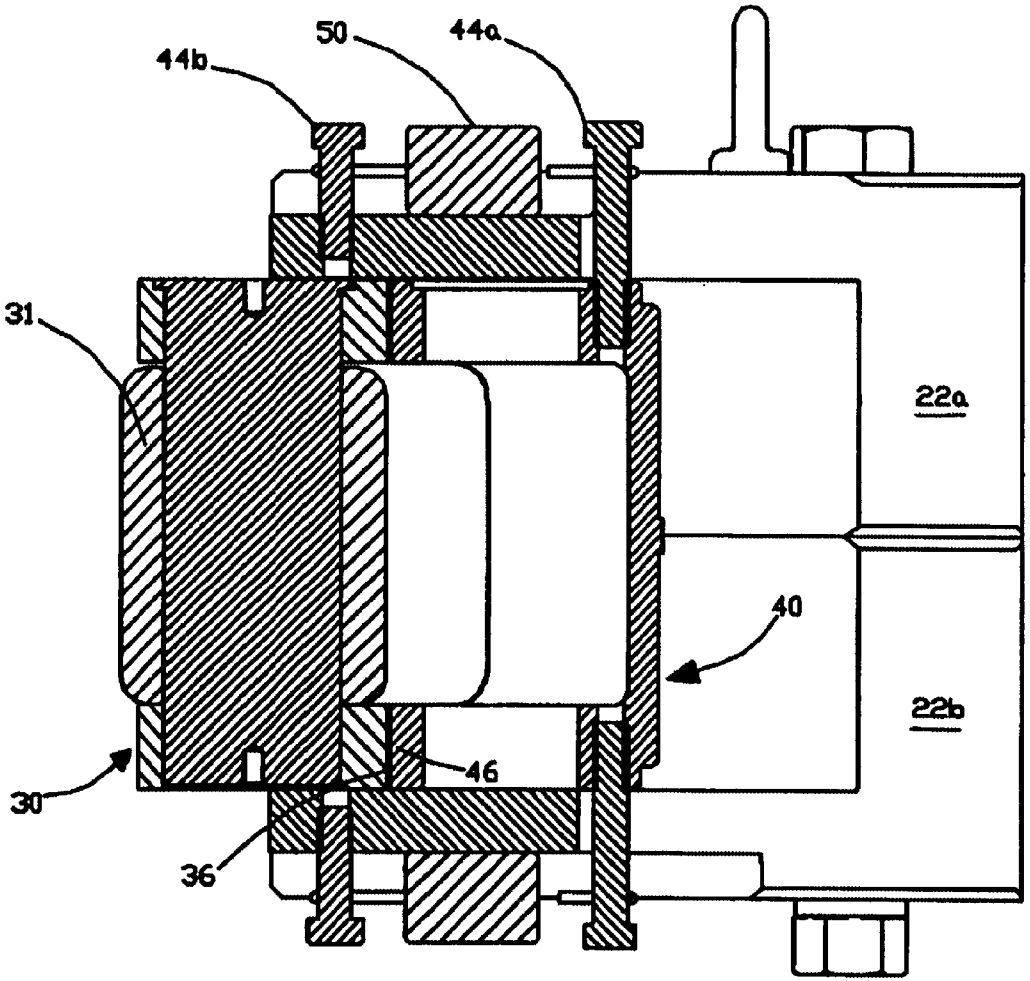
FIG. 6 is a sectional view of the sliding jaw adapter of the present invention.

A more detailed view of the mechanical relationship between pusher 30 and jaw member 40 may be seen in FIGS. 5 and 6. A front view of pusher 30 is seen in FIG. 5. In this embodiment, pusher 30 is formed with an front face 36 which is complementary to the rear face 46 of jaw member 40. Jaw member 40 may be any conventional power tong jaw such as seen in U.S. Pat. No. 5,911,786 to Buck which is incorporated by reference herein. Jaw member 40 (absent a roller or roller pin) will slide into passage 35 of adapter body 20 and abut up against the front face of pusher 30 as suggested in the cross-sectional view of FIG. 6. The spring pin 44*a* on jaw member 40 will engage retainer spring 50 and serve to bias jaw member 40 rearward against the front face 36 of pusher 30. It can be seen that pusher 30 acts as a reducer in power tongs which would normally be too large to accommodate jaw member 40. For example, if the power tong is a 14" diameter power tong and jaw member 40 an 8⅝" jaw (i.e designed to grip 8⅝" tubulars), jaw member 40 would be too small to properly operate in the power tong without special modification. However, by positioning pusher 30 between the ring gear cam surfaces and jaw member 40, pusher 30 effectively reduces the size of jaw members which can be utilized in the power tong.

Figure 1:
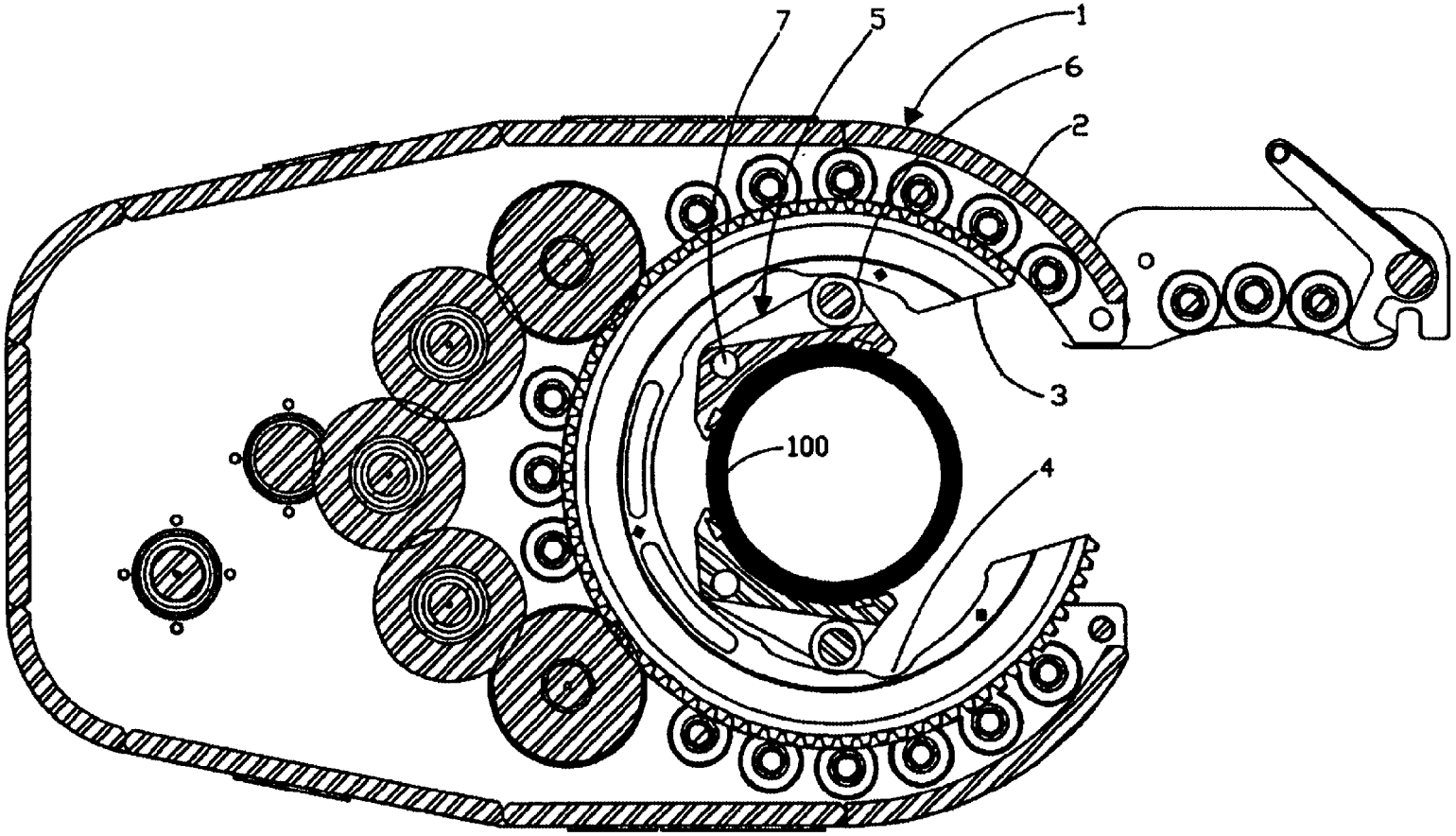
FIG. 1 PRIOR ART
FIG. 1 is a top view of the ring gear and jaws of a prior art pivoting jaw power tong.

FIG. 3 illustrates how sliding jaw adapter 20 will replace pivoting jaw 5 in a conventional pivoting jaw power tong. After pivot pin 7 is removed, pivoting jaws 5 may then be slid to the central throat opening of ring gear 3 and lifted out of the power tong. Thereafter, sliding jaw adapters 20 are positioned in place between the cages plates and then pivot pin 7 will be repositioned such that it extends through pivot pin aperture 25 on sliding jaw adapter 20. Locking pin 27 will extend through upper cage plate 8*a* to engage locking aperture 26 on sliding jaw adapter 20. At this point, sliding jaw adapter 20 is securely fixed between upper and lower cages plate 8*a* and 8*b*. FIG. 2 illustrates sliding jaw adapters 20 positioned within the power tong which previously housed the conventional pivoting jaws 5 seen in FIG. 1. FIG. 2 also shows a much smaller diameter, low tolerance, tubular member 110 which pivoting jaws 5 could not have properly gripped. However, the jaw members 40 positioned within adapter body 22 are able to effectively grip smaller diameter tubular 110. As ring gear 3 rotates, roller 31 on pusher 30 will travel up positive cam surface 4 on ring gear 3. This naturally will cause pusher 30 to move jaw member 40 toward and eventually into engagement with tubular 110. Just as clearly, when ring gear 3 rotates in the opposite direction, roller 31 will travel back to a neutral part of cam surface 4 and retainer springs 50 (FIG. 4) will pull jaw member 40 back away from and out of engagement with tubular 110. It will be noted that during the entire travel of jaw member 40, adapter body 22 did not move as it is held in place by pivot pin 7 and locking pin 27.

While the present invention has been described in terms of specific embodiments, those skilled in the art will recognize many variations and modifications which are with the scope of the present invention. All such variations and modifications are intended to come within the scope of the following claims.

We claim:

1. A method of converting a pivoting jaw power tong into a sliding jaw power tong, said method comprising the steps of:

a. providing a pivoting jaw power tong;

b. removing a pivoting jaw from said power tong;

c. positioning a sliding jaw adapter within said power tong, said sliding jaw adapter including:

i. an adapter body shaped to fit between cages plates of said power tong, said body also including sliding jaw passage; and ii. a sliding jaw member positioned within said sliding jaw passage.

2. The method of claim 1, wherein said adapter body includes a pinning assembly for fixing said adapter body against rotation relative to said cage plates.

* * * * *